United States Patent [19]

Tieckelmann et al.

[11] Patent Number: 5,006,124

[45] Date of Patent: Apr. 9, 1991

[54] WET PROCESSING OF DENIM

[75] Inventors: Robert H. Tieckelmann, Trenton; Randy A. Bull, Hopewell; Lisa M. Kurschner, Lawrenceville, all of N.J.

[73] Assignee: FMC Corporation, Philadelphia, Pa.

[21] Appl. No.: 451,067

[22] Filed: Dec. 15, 1989

[51] Int. Cl.[5] ..... D06L 3/02

[52] U.S. Cl. ..... 8/111; 8/101; 8/102

[58] Field of Search ..... 8/101, 102, 111

[56] References Cited

U.S. PATENT DOCUMENTS

| | | | |
|---|---|---|---|
| 3,650,673 | 3/1972 | Ehner | 8/137 |
| 3,811,833 | 5/1974 | Stalter | 8/111 |
| 3,945,936 | 3/1976 | Lucas et al. | 252/95 |
| 4,130,392 | 12/1978 | Diehl et al. | 8/101 |
| 4,218,220 | 8/1980 | Kappler et al. | 8/102 |
| 4,243,391 | 1/1981 | Puchta et al. | 8/111 |
| 4,391,723 | 7/1983 | Bacon et al. | 252/90 |
| 4,601,845 | 7/1986 | Namnath | 252/99 |
| 4,740,213 | 4/1988 | Ricci | 8/108.1 |
| 4,795,476 | 1/1989 | Bean et al. | 8/107 |
| 4,852,990 | 11/1989 | Patterson | 8/108.1 |
| 4,872,909 | 10/1989 | Allen et al. | 75/101 R |

*Primary Examiner*—Josephine Barr
*Assistant Examiner*—John F. McNally
*Attorney, Agent, or Firm*—Richard E. Elden; Robert L. Andersen

[57] ABSTRACT

An environmentally improved process is provided to fade denim fabric either as the woven fabric or after being made up into garments. The denim fabric may optionally be uniformly faded, or faded in a random pattern and stone washed. The effluent from the process does not have the disadvantage of the high COD of conventional processes.

19 Claims, No Drawings

WET PROCESSING OF DENIM

BACKGROUND OF THE INVENTION

An improved process is provided to fade denim fabric employing chemical treatment providing a decreased chemical oxygen demand.

Denim garments such as slacks, jackets and skirts are considered by many to be more fashionable once they have attained a faded, worn appearance. Accordingly, denim fabrics and garments are frequently subjected to a bleaching procedure during their manufacture to give them a bleached, superbleached, rifled or whitewashed appearance. While such prebleached goods are a very marketable product, the bleaching procedures conventionally employed are relatively labor intensive, which adds significantly to the cost of the bleaching process. U.S. Pat. No. 4,218,220 discloses that it is sometimes desirable to prepare prefaded denim garments uniformly faded, that is prefaded blue jeans free of unwanted streaks. Satisfactory, unstreaked, suitably faded blue jeans were hitherto obtained only by repeated washings. The patent teaches subjecting the denim fabric to a washing cycle comprising an initial wash with detergent and emulsifier, a suitable intermediate rinsing operation, a bleaching operation in which the garments are subjected to the simultaneous action of bleach and a fabric softener of the quaternary ammonium type, alone or with the addition of a suitable amount of detergent, a further rinsing operation, and an optional final treatment with fabric softener and laundry sour. The patent teaches the use of a chlorine bleach, such as, sodium hypochlorite or trichloroisocyanuric acid or the like as a bleach. U.S. Pat. No. 4,852,990 teaches a modification wherein denim garments first are desized, then contacted with an aqueous polyacrylic acid solution. A chlorine-type bleaching agent is subsequently added to provide a uniform bleached appearance.

Subsequently, the trend has been toward a look featuring random faded effects.

One such manifestation of this trend is the practice of stone-washing - that is, immersing cloth in water containing no other substance than pumice stones. The effect it is sought to produce on denim treated by this method is one of natural fading, a "used" look characterized by the contrast between light and dark areas; in made-up garments however, the effect tends to appear on and around the seams only, whereas the color of the remaining fabric remains substantially uniform.

U.S. Pat. No. 4,740,213 discloses a process in which granules of a coarse, permeable material, such as pumice, are impregnated with a chlorine bleaching agent tumbled in a drum with denim fabric in a dry state. Subsequent traces of the chlorine bleaching agent are removed, optionally by an antichlor such as acidic hydrogen peroxide.

However, chlorine bleaching agents are known to be very destructive to cotton, consequently alternative bleaching agents have been employed to produce the faded look. Potassium permanganate is very desirable for such an oxidative treatment. When applied in a solution an even fading is obtained, and when impregnated into an inert porous material it provides a desired random uneven oxidation of colorbodies when tumbled with fabric ("rocking"). Unfortunately, dark colored, insoluble manganese dioxide is deposited on the denim resulting in a dirty, stained appearance. The manganese dioxide can be removed by a process called "neutralizing", that is, reducing the manganese dioxide to soluble manganous salts, usually by sulfites, thiosulfate, hydroxylamine and the like. These reducing agents must be used in a large excess and at a pH of 2.5 to 3.0 causing damage to the cotton fibers. The excess reducing agent from the neutralizing step is very undesirable to dispose of because of its very high toxicity and high chemical oxygen demand.

After neutralizing the denim is frequently "brightened" or bleached to enhance the contrast between the dyed and the decolorized areas. Currently a hypochlorite bleach or a sodium perborate bleach bath is employed for brightening.

BRIEF SUMMARY OF THE INVENTION

The present invention is a process for wet processing denim fabric containing dyestuff colorbodies by desizing the denim fabric, washing the desized fabric, contacting the washed fabric with potassium permanganate to oxidize part of the colorbodies in the denim fabric to a form which is easily removed from the fabric surface, thereby decolorizing the denim fabric, and neutralizing the decolorized denim fabric by removing residues of the potassium permanganate and of the oxidized colorbodies, the improvement comprising the steps of (a) neutralizing the oxidized denim fabric by (i) immersing the denim fabric in about 5 to 20 parts by weight of a first aqueous solution per part by weight denim fabric, (ii) maintaining said first aqueous solution between pH 3.0 and 6.0, (iii) subsequently incorporating about 2 parts by weight of either a monodentate or multidentate carboxylic acid chelating agent or salt or combination thereof, and 1 part by weight hydrogen peroxide, and (iv) maintaining said first aqueous solution at about 65° C. to 90° C. for 5 to 15 minutes, and (b) bleaching the decolorized denim fabric by contacting said denim fabric for 4 to 8 minutes at 65° C. to 90° C. with 5 to 20 parts by weight of an alkaline bleaching solution comprising from about 0.6 to about 4 parts by weight hydrogen peroxide and sufficient alkali to provide a pH of about 8 to 9.

DETAILED DESCRIPTION OF THE INVENTION

Unless otherwise specified percent or parts by weight is on the basis of 100% of undiluted compound by weight. For example, 1 part by weight hydrogen peroxide requires 2 parts by weight of an aqueous solution of 50% $H_2O_2$. However, 3 parts by weight 35% $H_2O_2$ is equivalent to about 1 part by weight hydrogen peroxide on a 100% basis.

The denim fabric may be treated in any convenient form such as uncut piece goods, as partially fabricated garments or as finished garments. Denim is conventionally woven with colored warp and white filling threads but would include striped denim fabrics or denim fabrics woven with both warp and filling threads colored. Usually the denims are dyed with vat dyes such as indigo or sulfur dies or the like. Denim fabrics may also be woven with mixtures of cotton and synthetic fibers.

The process is particularly useful for producing a denim with a random faded pattern by the process of desizing the denim fabric, washing the desized fabric, contacting the washed fabric with potassium permanganate to oxidize part of the colorbodies in the denim fabric to a form which is easily removed from the fabric surface, thereby decolorizing the denim fabric, and neutralizing the decolorized denim fabric by removing residues of the potassium permanganate and of the oxidized colorbodies, the improvement comprising the steps of (a) neutralizing the oxidized denim fabric by (i) immersing the denim fabric in about 5 to 20 parts by weight of a first aqueous solution per part by weight denim fabric, (ii) maintaining said first aqueous solution between pH 3.0 and 6.0, (iii) subsequently incorporating about 2 parts by weight of either a monodentate or multidentate carboxylic acid chelating agent or salt or combination thereof, and 1 part by weight hydrogen peroxide, and (iv) maintaining said first aqueous solution at about 652° C. to 90° C. for 5 to 15 minutes, and (b) bleaching the decolorized denim fabric by contacting said denim fabric for 4 to 8 minutes at 65° C. to 90° C. with 5 to 20 parts by weight of an alkaline bleaching solution comprising from about 0.6 to about 4 parts by weight hydrogen peroxide and sufficient alkali to provide a pH of about 8 to 9.

Optionally, the denim fabric may be desized by contacting the denim fabric with an effective amount of a peroxygen compound and 0.2% to 3% surfactant (preferably 1% to 2%) at pH 7-12 (preferably 9-10) for a sufficient time (5-15 minutes, preferably 10-12 minutes), thereby substantially removing sizing therefrom. An effective amount of a peroxygen compound for desizing is desirably 0.5% to 3% sodium persulfate or 2% to 6% hydrogen peroxide (100% basis). This process overcomes the environmentally-undesirable effluents from current desizing processes employing enzymes or sodium perborate.

Either sodium persulfate or hydrogen peroxide are particularly desirable to remove both starch and polyvinyl alcohol, the two types of sizing generally used for weaving denims.

Typical directions for wet finishing denim fabric with a random faded effect are described below for finished garments which have been inverted (turned inside out). As used herein all percentages are by weight; "owg" stands for on weight of goods.

EXAMPLES

Desizing

Add the inverted garments to a large washer. Fill the washer with enough hot water (65°-90° C.; 150°-190° F.) to produce a goods to liquor ratio of 1:20 or less. Add 2%-6% on the weight of the goods (owg) 35% $H_2O_2$ (3%-4% owg optimum). Add a wetting agent or surfactant 0.2%-3% owg (1%-2% optimum) and enough alkali to reach a pH of 7-12 (9-10 optimum). React 8-15 minutes (10-12 optimum). Rinse with hot water (65°-90° C.; 150°-190° F.) agitating 4-10 minutes. Repeat rinse as necessary to prevent the redeposition of size.

Sodium persulfate 0.5%-3% owg (1%-2% owg optimum) can be substituted for $H_2O_2$ in desizing. Optimum temperature is 80°-85° C. (175°-185° F.).

Neutralizing

After rocking, add the garments to a large washer and fill to the highest level with hot water (65°-90° C.; 150°-190° F.). Add 2%-3% owg neutral detergent. Agitate 4-10 minutes and drain. Begin the neutralization process immediately after the prewash. Fill washer with hot water (65°-90° C.; 150°-190° F.) to a el that yields a goods to liquor ratio of 1:20 or less. Add in the following order: 2 parts glacial acetic acid, 2 parts chelating agent, 3 parts 35% $H_2O_2$. $H_2O_2$ 35% should be in the range of 2%-5% owg (3%-4% optimum). (The pH of this system is approximately 4, considerably higher than the pH of 2.5-3 obtained when using sulfite or hydroxylamine systems.) At this pH, there is no additional damage to the garment. Agitate 5-15 minutes (10-12 minutes optimum) and drain. Fill washer to the highest level with hot water (65°-90° C.; 150°-190° F.). Agitate 2-6 minutes to rinse and drain. Repeat neutralization step above, but add 1%-4% owg (2%-3% owg optimum) neutral detergent. Following the second neutralization step, fill the washer to the highest level with hot water (65°-90° C.; 150°-190° F.). Agitate 2-6 minutes and drain. Repeat as necessary to remove detergent and establish a neutral rinse pH.

The chelating agents may be any multidentate carboxylic acid based agent, particularly those showing affinity for manganese or promoting the reduction of manganese (VII, V or IV) to manganese II, for example, EDTA (ethylenediamine tetraacetic acid), DTPA (diethylenetriamine pentaacetic acid). A commercial product such as Dow Chemical Corporation's Versenex 80 TM which contains >38% pentasodium DTPA and other noninert compounds is particularly convenient.

After removal of insoluble $MnO_2$ and rock powder, the garments are treated with an alkaline formulation of $H_2O_2$ as a replacement for hypochlorite or perborate. This step bleaches the decolorized portions of the garment enhancing the contrast between dyed and decolorized areas.

Bleaching

Immediately following the final rinses of neutralization, fill washer with hot water (65°-90° C.; 150°-190° F.) to a level that produces a goods to liquor ratio of 1:20 or less. Add 2%-5% owg 35% $H_2O_2$ (3%-4% owg optimum), optical brightener and enough alkali to yield a pH of 8-9. The pH should not exceed 9.5. Agitate 4-8 minutes and drain. Fill washer to highest level with warm water (35°-50° C.; 90°-120° F.). Agitate 2-4 minutes and drain. Repeat as necessary to yield a rinse pH near neutral. Fill washer with warm water (35°-50° C.; 90°-120° F.) to a level that produces a goods to liquor ratio of 1:20 or less. Add softener and ozone inhibitors. Agitate 4-8 minutes, drain and extract.

EXAMPLE 1

Desizing of Garments-Production Facility

One hundred twenty pair (about 100 kg) of blue denim jeans were inverted and added to a 200 kg capacity washer. The washer was filled to high level with hot water (75° C.) to maintain a goods to liquor weight ratio of 1:20 or less. About 1.8 kg, 35% $H_2O_2$, 85 g nonionic liquid detergent and enough caustic or soda ash to reach a pH of 9 were added; the garments were agitated 7 minutes and drained. The washer was then filled to high level with hot water (75° C.); agitated 4 minutes and drained. Washer was filled again to high level with warm water (45° C.); agitated 4 minutes, drained and extracted.

EXAMPLE 2

Decolorization of Garments-Production Facility

Desized garments were righted and 60 garments (about 50 kg) were added to a tumbler containing 100-150 kg $KMnO_4$ soaked pumice stones. Stones and garments were tumbled (rocked) together for 20 minutes.

EXAMPLE 3

Clean-up of Decolorized Garments-Production Facility

Garments decolorized in Example 2 appeared brown and gritty. Removal of the brown stain was necessary to obtain the desired appearance. One hundred twenty (about 100 kg) "rocked" jeans were added to a 200 kg capacity washer. Washer was filled to high level with hot water 175° C.; 110 g neutral liquid detergent was added, the garments were agitated 4 minutes and drained. The washer was filled to low level with hot water (75° C.) to maintain a goods to liquor ratio of 1:20 or less. Added in this order were 1.6 kg glacial acetic acid and 1.6 kg of Versenex 80 TM chelating agent (Dow Chemical). Then 2.45 kg of 35% $H_2O_2$ was added. The garments were agitated 7 minutes and drained. The washer was filled again to high level with hot water (75° C.); 110 g neutral liquid detergent was added; the garments were agitated 2 minutes and drained. Then the washer was filled to low level with hot water; 1.6 kg glacial acetic acid, 1.6 kg chelating agent and 2.45 kg 35% $H_2O_2$ were added. The garments were agitated 7 minutes, drained and extracted. The washer was filled to high level with hot water (75° C.), agitated 2 minutes and drained. The rinse was repeated. The washer was then filled to high level with hot water (75° C.); 3.6 kg 35% $H_2O_2$ and enough alkali to reach a pH of 9 were added. Garments were agitated 4 minutes and drained. Washer was filled to high level with warm water (45° C.), agitated 2 minutes and drained. The rinse was repeated and garments were extracted.

Garments produced were free of brown discoloration and showed good contrast between dyed (blue) and decolorized (white) areas.

EXAMPLE 4

Desizing-Laboratory

Denim fabric used was supplied by Cone Mills. Fabric was cut into 4"×4" swatches. Desizing was performed on a TERGOTOMETER, United States Testing Co. Swatches were weighed to determine average sample weight. This weight was used in all calculations. Goods to liquor ratio was maintained at 1:20. Eight swatches were added to each station of the TERGOTOMETER and 2% owg of 35% $H_2O_2$ and 1.0% owg Rapid Scour (Gist Brocades USA Inc., Charlotte, N.C.) were added. The pH was adjusted to 9 with 1N NaOH and the samples were agitated 12 minutes at 65° C. The desizing liquor was dropped and the samples rinsed with water for 4 minutes at 65° C. The rinse was repeated and the samples air dried.

EXAMPLE 5

Decolorization-Laboratory

Desized samples were added to a 500 mL Erlenmeyer flask (placed flat, face-up). A 2% $KMnO_4$ solution (50 mL) was added to the flask and reacted 15 minutes at room temperature. The spent solution was dropped and the sample rinsed twice with 100 mL portions of deionized water.

EXAMPLE 6

Clean-up of Decolorized Garments-Laboratory

Immediately following decolorization, samples were reacted with 100 mL neutralization liquor to maintain a goods to liquor ratio of 1:20. Neutralization liquor was prepared by adding 3% owg 35% $H_2O_2$, 2% owg acetic acid and 2% owg chelating agent to deionized water and bringing the volume to 100 mL. Chelating agent used was Versenex 80 TM Other polydentate chelating agents may be used and mention of this product is not to limit the scope of this invention. Sample and the liquor were agitated for 10 minutes at 65° C. in an oscillating bath. The liquor was dropped and the neutralization step repeated. After the second neutralization, the liquor was dropped and the sample was brightened by adding 100 mL of a 2% owg $H_2O_2$ solution adjusted to pH 9 with NaOH. Sample and liquor were agitated for 10 minutes at 65° C. in an oscillating bath. Following brightening, the sample was rinsed twice with 100 mL portions of deionized water for 2 minutes in the oscillating bath at 65° C. Samples were air dried.

We claim:

1. In a process for wet processing denim fabric containing dyestuff colorbodies by desizing the denim fabric, washing the desized fabric, contacting the washed fabric with potassium permanganate to oxidize part of the colorbodies in the denim fabric to a form which is easily removed from the fabric surface, thereby decolorizing the denim fabric, and neutralizing the decolorized denim fabric by removing residues of the potassium permanganate and of the oxidized colorbodies, the improvement comprising the steps of (a) neutralizing the oxidized denim fabric by (i) immersing the denim fabric in about 5 to 20 parts by weight of water per part by weight denim fabric, (ii) maintaining said water solution between pH 3.0 and 6.0, (iii) subsequently incorporating into the water about 2 parts by weight of either a monodentate or multidentate carboxylic acid chelating agent or salt or combination thereof owg to provide a first aqueous solution, and 1 part by weight hydrogen peroxide owg to provide a first aqueous solution, and (iv) maintaining said first aqueous solution at about 65° C. to 90° C. for 5 to 15 minutes, and (b) bleaching the decolorized denim fabric by contacting said denim fabric for 4 to 8 minutes at 65° C. to 90° C. with 5 to 20 parts by weight of an alkaline bleaching solution owg comprising from about 0.6 to about 4 parts by weight hydrogen peroxide owg and sufficient alkali to provide a pH of about 8 to 9.

2. The process of claim 1, wherein the denim fabric is desized by contacting the denim fabric with an effective amount of a peroxygen compound and 0.2% 3% surfactant owg at pH 7–12 for a sufficient time, thereby substantially removing sizing therefrom.

3. The process of claim 2 wherein the effective amount of a peroxygen compound is 0.5% to 3% sodium persulfate owg.

4. The process of claim 2 wherein the effective amount of a peroxygen compound is 2% to 6% hydrogen peroxide owg.

5. The process of claim 1 comprising repeating said neutralizing step with a second aqueous solution comprising said first aqueous solution, containing in addition 1 to 4 parts by weight neutral detergent owg.

6. The process of claim 1 wherein the denim fabric is made up in the form of garments.

7. The process of claim 2 wherein the denim fabric is made up in the form of garments.

8. The process of claim 3 wherein the denim fabric is desized at a pH of 7 to 10 for 10 to 12 minutes.

9. The process of claim 5 wherein the denim fabric is desized at a pH of 7 to 10 for 10 to 12 minutes.

10. In a process for wet processing denim fabric containing dyestuff colorbodies by desizing the denim fabric, washing the desized fabric, rocking the washed fabric by contacting the washed fabric with inert, porous structures impregnated with potassium permanganate to oxidize part of the colorbodies in the denim fabric to a form which is easily removed from the fabric surface, thereby decolorizing the denim fabric, and neutralizing the decolorized denim fabric by removing residues of the potassium permanganate, of the oxidized colorbodies and of particulate inert portions of said porous structures, the improvement comprising the steps of (a) neutralizing the oxidized denim fabric by (i) immersing the denim fabric in about 5 to 20 parts by weight of water per part by weight denim fabric, (ii) maintaining said first aqueous solution between pH 3.0 and 6.0, (iii) subsequently incorporating about 2 parts by weight of either a monodentate or multidentate carboxylic acid chelating agent or salt or combination thereof owg, and 10 parts by weight hydrogen peroxide owg to provide a first aqueous solution, and (iv) maintaining said first aqueous solution at about 65° C. to 90° C. for 5 to 15 minutes, and (b) bleaching the decolorized denim fabric by contacting said denim fabric for 4 to 8 minutes at 65° C. to 90° C. with 5 to 20 parts by weight of an alkaline bleaching solution owg comprising from about 0.6 to about 4 parts by weight hydrogen peroxide owg and sufficient alkali to provide a pH of about 8 to 9.

11. The process of claim 10 wherein the denim fabric is desized by contacting the denim fabric with an effective amount of a peroxygen compound and 0.2% to 3% surfactant owg at pH 7–12 for a sufficient time, thereby substantially removing sizing therefrom.

12. The process of claim 11 wherein the effective amount of a peroxygen compound is 0.5% to 3% sodium persulfate owg.

13. The process of claim 11 wherein the effective amount of a peroxygen compound is 2% to 6% hydrogen peroxide owg.

14. The process of claim 10 comprising repeating said neutralizing step with a second aqueous solution comprising said first aqueous solution, containing in addition 1 to 4 parts by weight neutral detergent owg.

15. The process of claim 10 wherein 1 to 4 parts by weight of a detergent owg is added to the neutralizing step.

16. The process of claim 10 wherein the denim fabric is made up in the form of garments.

17. The process of claim 11 wherein the denim fabric is desized at a pH of 9 to 10 for 10 to 12 minutes.

18. The process of claim 14 wherein the denim fabric is desized at a pH of 9 to 10 for 10 to 12 minutes.

19. The process of claim 15 wherein the denim fabric is desized at a pH of 9 to 10 for 10 to 12 minutes.

* * * * *

UNITED STATES PATENT AND TRADEMARK OFFICE

CERTIFICATE OF CORRECTION

PATENT NO. : 5,006,124

DATED : April 9, 1991

INVENTOR(S) : Robert H. Tieckelmann, Randy A. Bull and Lisa M. Kurschner

It is certified that error appears in the above-identified patent and that said Letters Patent is hereby corrected as shown below:

Column 3, line 13, "652°C" should read --65°C--; line 65, "to a el that" should read --to a level that--. Column 6, lines 36-38, "or salt or combination thereof owg to provide a first aqueous solution, and 1 part by weight hydrogen peroxide owg to provide a first aqueous solution, and" should read --or salt or combination thereof owg, and 1 part by weight hydrogen peroxide owg to provide a first aqueous solution, and--. Column 7, line 18, "maintaining said first aqueous solution between" should read --maintaining said water between--.

Signed and Sealed this

Eighteenth Day of August, 1992

*Attest:*

DOUGLAS B. COMER

*Attesting Officer*

*Acting Commissioner of Patents and Trademarks*